United States Patent [19]

Dechantsreiter

[11] 3,987,905

[45] Oct. 26, 1976

[54] OVERHEAD CRANE INCLUDING GRAPPLE MEANS

[75] Inventor: Max J. Dechantsreiter, Milwaukee, Wis.

[73] Assignee: Harnischfeger Corporation, West Milwaukee, Wis.

[22] Filed: Jan. 27, 1975

[21] Appl. No.: 544,231

[52] U.S. Cl. ..... 212/18; 212/125; 214/653; 214/655

[51] Int. Cl.[2] ..... B66C 17/00

[58] Field of Search ..... 214/650–654, 214/658, 655; 294/106, 63 R, 67 BC, 67 BB; 212/11, 42, 18, 124–129

[56] References Cited

UNITED STATES PATENTS

| | | | |
|---|---|---|---|
| 1,295,163 | 2/1919 | Henricks | 294/106 |
| 1,764,623 | 6/1930 | Grondahl | 294/67 BC |
| 2,088,519 | 7/1937 | Hershey | 294/106 |
| 2,323,810 | 7/1943 | Fontaine | 214/655 |
| 2,360,740 | 10/1944 | Sturdy | 294/67 BC |
| 2,611,498 | 9/1952 | Broersma | 214/652 |
| 2,822,094 | 2/1958 | Greer | 212/42 X |
| 3,247,974 | 4/1966 | Dechantsreiter | 212/128 X |
| 3,690,715 | 9/1972 | Vanlingen | 212/129 X |
| 3,738,500 | 6/1973 | Coleman et al. | 212/66 |

FOREIGN PATENTS OR APPLICATIONS

| | | | |
|---|---|---|---|
| 2,126,147 | 12/1972 | Germany | 212/11 |
| 2,016,446 | 11/1971 | Germany | 294/67 BC |
| 2,100,840 | 7/1971 | Germany | 214/653 |
| 51,648 | 8/1966 | Poland | 294/106 |

*Primary Examiner*—Frank E. Werner
*Assistant Examiner*—R. B. Johnson
*Attorney, Agent, or Firm*—James E. Nilles

[57] ABSTRACT

A grapple assembly to be used in conjunction with an overhead crane providing means for picking up and transporting a plurality of blocks of heavy material simultaneously. The grapple assembly includes an elongated horizontal frame member suspended from an overhead crane, the frame member supporting a plurality of vertically extending opposed pairs of pivotable clamping members. The clamping members are each pivotably connected to the sides of the frame member and connected to a toggle linkage drive means such that a downwardly extending portion of each pair of the clamping members can firmly grip a block of material. The toggle linkage drive means are each secured to a central drive shaft which is, in turn, connected to a hydraulically driven rack and pinion. The toggle linkage drive means are also provided with spring biasing means to lock the clamping members in clamping position such that the blocks will not be released during transfer even if the hydraulic power is cut off.

5 Claims, 12 Drawing Figures

OVERHEAD CRANE INCLUDING GRAPPLE MEANS

BACKGROUND OF THE INVENTION

This invention pertains generally to transverse hoists or travelling cranes which are adapted to travel along a path and which have a downwardly extending, telescoping mast. At the lower end of the mast, grapple means are provided for load handling and have clamping or grabbing means which releasably grasp the container or load.

These overhead cranes find particular utility in warehouses, foundries or the like.

Numerous overhead travelling cranes having grapple means have been proposed and have proven satisfactorily for their intended purposes. However, they do have certain shortcomings in that, for example, some of them require that the grasping means be inserted under the object to be lifted. Other prior art cranes are incapable of grasping a plurality of objects at one time and securely holding them on their sides and then transporting and accurately positioning them in closed, stacked relationship, for example.

SUMMARY OF THE INVENTION

The present invention is directed to grapple apparatus used in conjunction with an overhead crane to provide means to securely grip a plurality of large blocks of material simultaneously and to move the blocks from one place to another.

The invention includes a grapple assembly which is suspended from an overhead crane in such a manner that is may be freely raised or lowered and translationally moved by the crane. The clamping assembly includes a plurality of pairs of vertically extending clamping arms pivotably mounted on opposite sides of a horizontal frame member such that clamping plates fixed to the lower ends of the arms may be forced toward each other, so that each opposed pair may be securely clamped against the side surfaces of a block of material. The means for clamping the plates together comprises a driven crank or toggle linkage assembly secured to the upper surface of the frame member and located between the upper ends of each pair of opposed clamping arms. Each toggle linkage assembly forces the upper ends of the clamping arms outwardly away from each other thereby causing the lower end of the arms having the plates attached thereto to move toward each other in clamping engagement. The respective toggle linkage assemblies are driven by a central drive shaft which is in turn connected to a hydraulically operated rack and pinion.

The clamping force developed by the apparatus of the invention is sufficient to allow the blocks of material to be lifted without the necessity of projections that extend under the blocks such that the blocks may be stacked directly on top of each other and no pallets or other spacing means are needed.

The apparatus of the instant invention is particularly useful for transporting large blocks of relatively soft carbon. Use of the instant invention allows the blocks to be stored closely together because the invention can grip an entire row of blocks simultaneously and because the invention requires little space between adjacent rows of blocks, thus saving storage space. The instant invention also avoids the necessity of complicated hardware to support each block separately, and the apparatus saves time required to move the blocks particularly because a plurality of blocks can be transported simultaneously.

DESCRIPTION OF THE PREFERRED EMBODIMENT

Figure 2:
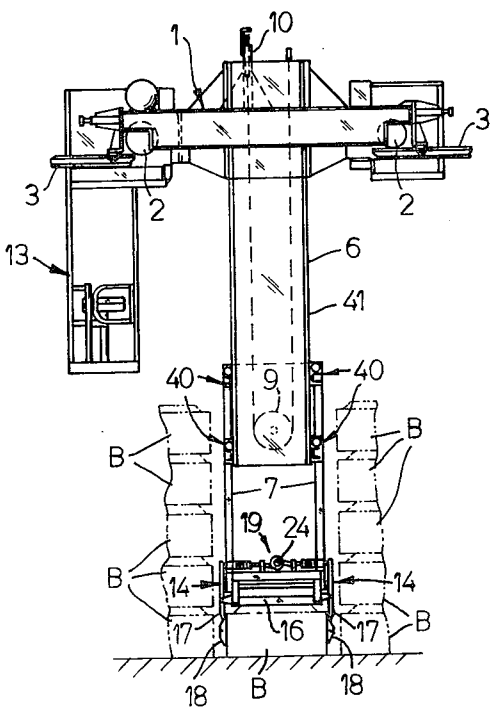
FIG. 2 is an end elevation of the apparatus shown in FIG. 1.
Figure 1:
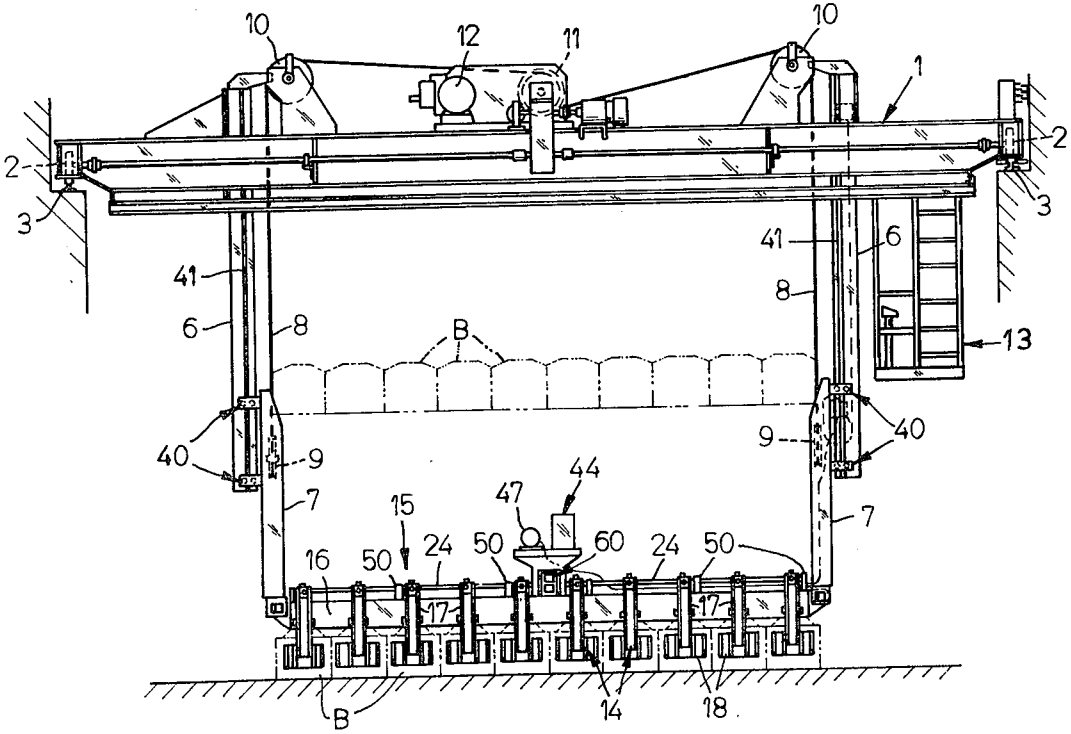
FIG. 1 is a side elevation of the apparatus of the present invention including the overhead crane assembly with the grapple assembly suspended therefrom.

Referring to the embodiment of the invention shown in FIGS. 1 and 2, the apparatus shown generally comprises an overhead crane supporting a grapple assembly suspended therefrom. The overhead crane comprises a bridge assembly 1 being mounted on rollers 2 such that it is movable on the rails 3. The bridge assembly 1 supports a motor assembly 4 and drive shaft 5 for moving the bridge on the rails 3. The bridge also supports downwardly extending rigid masts 6 and mast extensions 7 connected thereto. The mast extensions 7 are movable vertically with respect to the bridge assembly by the wire ropes 8 wound around pulleys 9 and 10 and winch 11 in turn powered by motor 12, such that the vertical position of the mast extension can be controlled. The mast extensions 7 are secured to the downwardly extending masts 6 by roller assemblies 40 which are guided by the tracks 41 on the mast 6. The bridge 1 also supports an opeator's cab 13.

The lower ends of the mast extensions 7 support opposite ends of a horizontally extending grapple assembly 15 such that the grapple assembly 15 can be moved vertically by the mast extension 7 and horizontally by the bridge 1.

A more detailed view of the grapple assembly 15 can be seen in FIGS. 3–4 and 6–7. Generally, the grapple assembly consists of a horizontally extending frame member 16, a plurality of opposed pairs of vertically mounted clamping arms 17 pivotably attached to each side of the frame 16, and a plurality of overcenter locking assemblies 19 connected to central drive shafts 24 for pivotably driving each opposing set of clamping arms 17 simultaneously into clamping relationship against a block of material B, such that the grapple means may pick up an entire row of blocks simultaneously.

CLAMPING ARM ASSEMBLY

FIGS. 3–4 and 6–8 show the clamping arm assembly and the means by which the clamping arm 17 is fixed to the frame 16 and to the overcenter locking assembly 19. The clamping arms 17 are each connected at a point generally intermediate their length to the frame 16 by brackets 20*a* secured to the clamping arm, brackets 20*b* secured to the frame and pivot pins 21 extending through bores in the brackets. At the lower end of the clamping arms 17 are clamping plates 18 pivotably connected to the arms 17 by pivot pins 22 and generally held in alignment by extension springs 23. The clamping plates are pivotably mounted to the clamping arms so that they may be positioned flat against the surface of the block B.

Figures 8, 12:
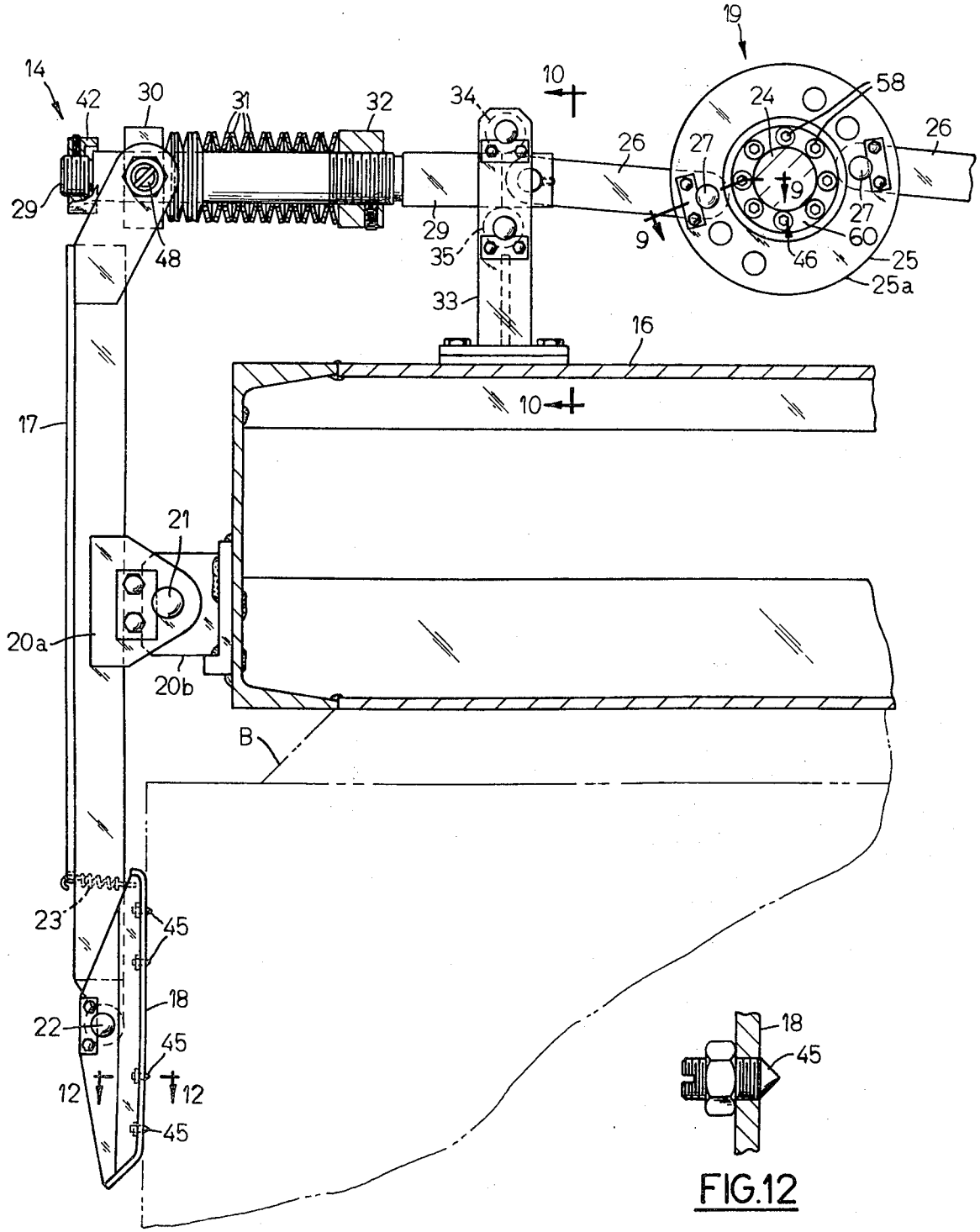
FIG. 8 is an enlarged partially cut-away view of the clamping means shown in FIGS. 6 and 7.
FIG. 12 is an enlarged cross section of a cone pointed screw secured in the clamping plate, taken along a line 12—12 in FIG. 8.

To insure that the clamping plates 18 securely grip the block of material B clamped between them, the plates are provided with cone point screws 45 threaded through the plate as shown in FIG. 12. The purpose of the screws is to provide points extending from the plate to act as gripping members. For example, when the block of material consists of carbon having a relatively soft consistency, the point of the screws may become imbedded in the carbon such that the block is securely clamped.

OVERCENTER LOCKING ASSEMBLY

As shown in FIGS. 3–4 and 6–9 each opposed pair of clamping arms 17 is operably connected to a hydraulically powered drive shaft 24 by an overcenter locking assembly 19. The locking assembly 19 generally includes a flanged hub 25 which is fixed to the drive shaft 24, two cranks or toggle arms 26 each pivotably connected at one end by a pin 27 to radially opposite sides of the flanged hub 25, and two shafts 29 each pivotably attached at one end to the other end of the toggle arms 26 and slideably connected to the upper end of the clamping arm 17 at the other.

The flanged hub 25 is shown in FIGS. 3–4 and 8–9. The hub 25 generally comprises a central portion having a bore for accommodating the drive shaft 24 and two radially extending spaced flanges 25*a* and 25*b*. The central portion of the hub 25 is provided with an expandable adjustment means 46 for securing the hub to the drive shaft as shown in cross section in FIG. 9. The expandable adjustment means 46 includes two expandable concentric bands 54 and 56 positioned between the hub 35 and the drive shaft 24. The bands define an annular space for receiving a plurality of screws 58 and opposed interior bands 60 and 62. When the screws 58 are tightened, the bands 60 and 62 are pulled together such that the expandable band 54 is pressed outwardly against drive shaft 24 and the band 56 is pressed inwardly against the bore of the hub 25 thereby securing the hub 25 to the drive shaft 24. The use of the expandable adjustment means to attach the hub 25 to the drive shaft 24 allows the hub to be securely fixed to the drive shaft 24 but also allows axial positioning or twisting of the hub 25 on the drive shaft to facilitate alignment of each of the locking assemblies by loosening the concentric bands 54 and 56.

Figure 9:
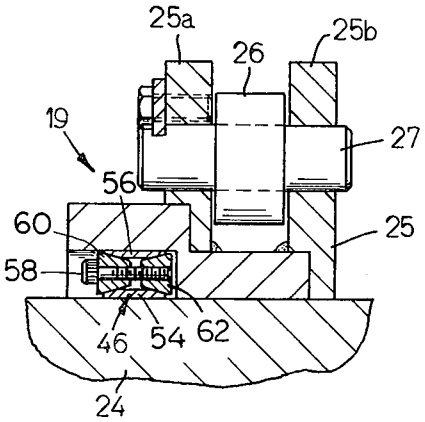
FIG. 9 is an enlarged, cross section taken along line 9—9 shown in FIG. 8.

The two toggle arms 26 are pivotably attached to the flanges 25*a* and 25*b* of the hub by pins 27 which are located in aligned bores extending through the flanges and through the ends of the arms 26 (FIG. 9). The flanges are provided with a plurality of such bores at varied radii to facilitate greater or lesser movement of the clamping arms as will become clear hereinafter. Each of the toggle arms 26 is pivotably attached at its other end to an axially reciprocable shaft 29.

Figure 10:
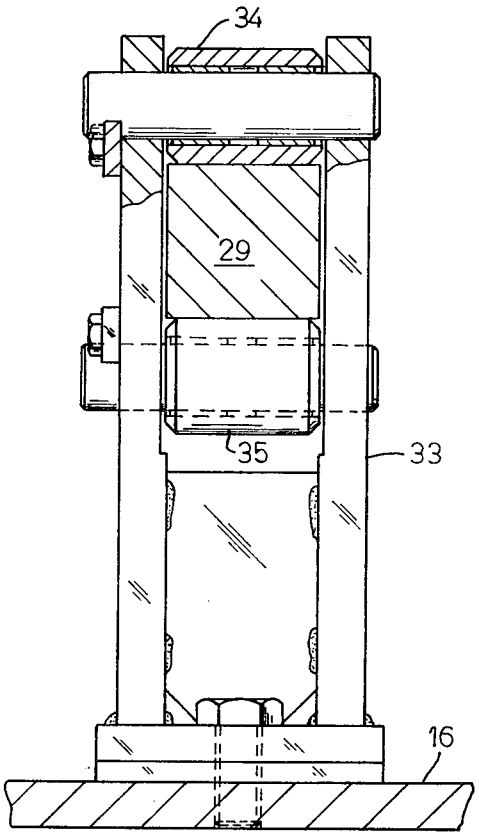
FIG. 10 is an enlarged, cross section taken along lines 10—10 shown in FIG. 8 with certain parts broken away for the sake of clarity.
Figure 11:
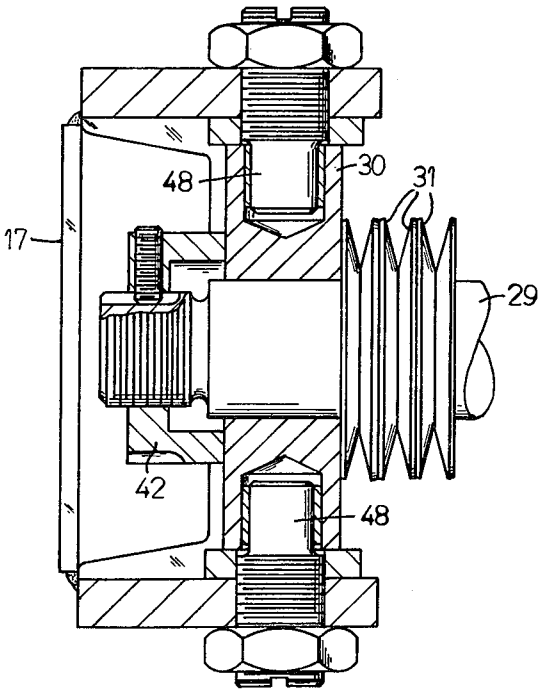
FIG. 11 is an enlarged cross section generally taken along line 11—11 shown in FIG. 6.

The means by which the reciprocable shaft 29 is supported is shown in FIGS. 8 and 10–11. At its end closest to the drive shaft 24, the shaft 29 is supported by bearing members 34 and 35 rotatably mounted in bracket 33 as shown in FIG. 10. The purpose of the bracket 33 and the bearing members 34 and 35 is to support the shaft 29 that is at axially reciprocable in response to the movement of the toggle arm but not vertically movable. The shaft 29 is also provided with a plurality of stacked compressible spring discs 31 which are secured on the shaft 29 and located between an axially slideably guide block 30 and a nut 32 threadably fixed to the shaft at a point generally intermediate its length. The guide block 30 is slideably mounted on the shaft 29 and is pivotably secured by pivot pins 48 to the upper end of the clamping arm 17 as shown in FIG. 11. The guide block 30 is attached to the clamping arm in such a manner that axial movement of the guide block along the shaft 29 in response to compressive forces of the spring causes clamping force to be applied to the arm 17. The shaft 29 is also provided with a second nut 42 threadeably secured to the end of the shaft 29 and designed to limit the movement of the guide block 30 on the shaft.

In operation, when the shaft 29 is axially reciprocated away from the drive shaft as a result of forces applied by the toggle arm 26, the nut 32 compresses the stacked spring discs against the guide block 30 thereby causing clamping forces to be applied to the clamping arm 17.

HYDRAULIC DRIVE ASSEMBLY

Figure 4:
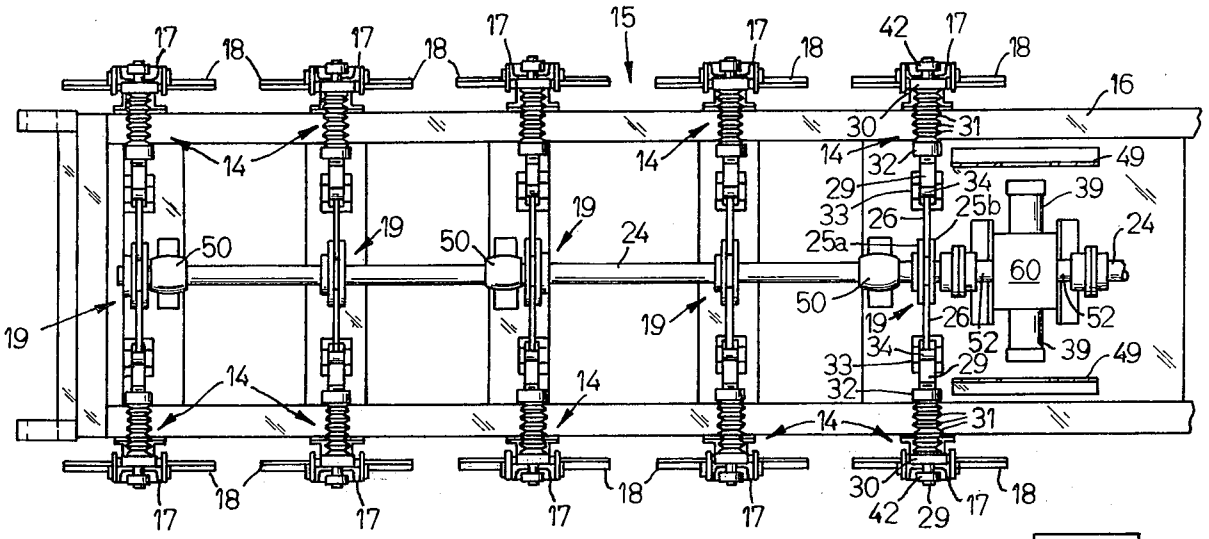
FIG. 4 is an enlarged partial top view of the grapple assembly apparatus shown in FIG. 1.
Figure 3:
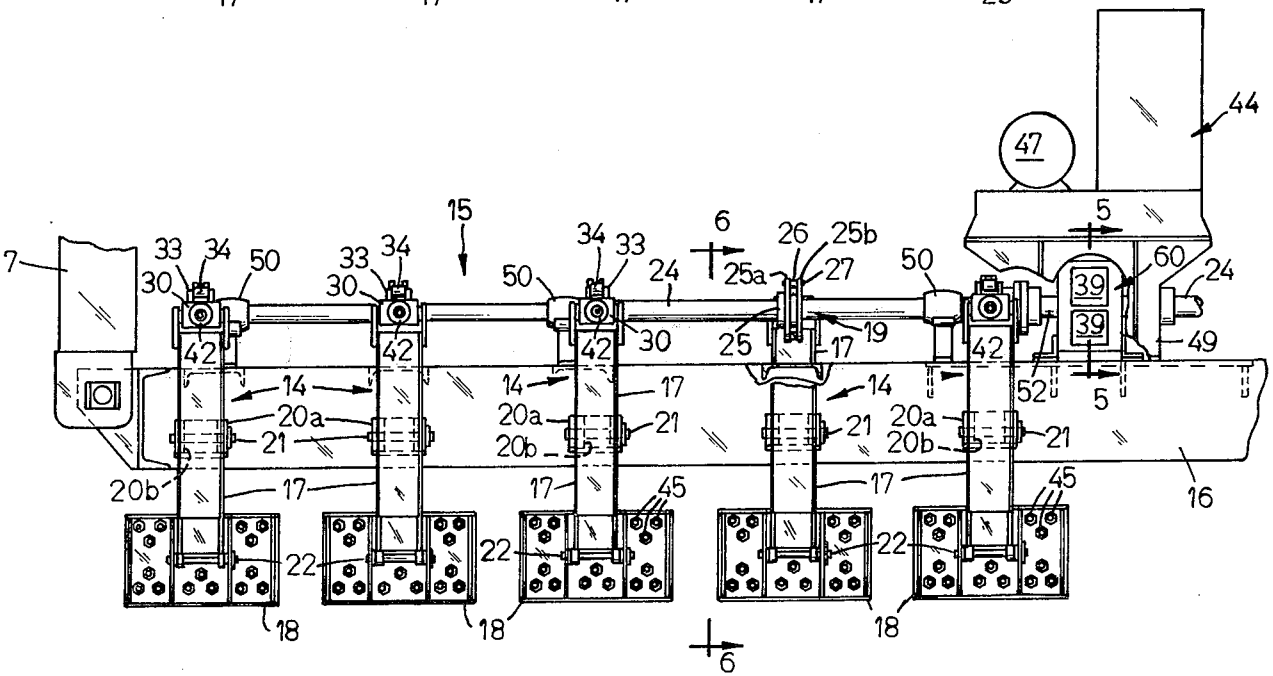
FIG. 3 is an enlarged partial side view of the grapple assembly apparatus.
Figure 5:
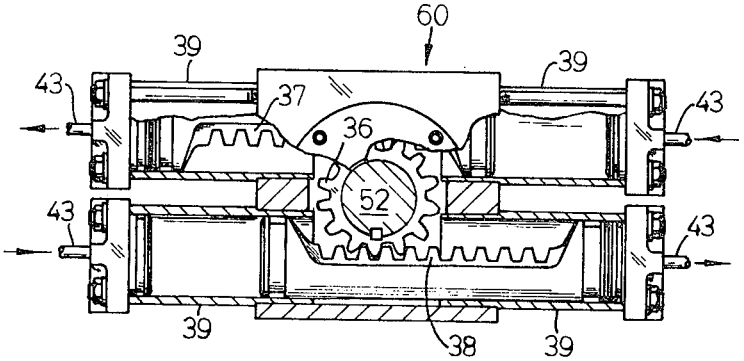
FIG. 5 is an enlarged partially cut-away end view of the rack and pinion drive means taken along line 5—5 in FIG. 3.

The means by which clamping force is applied to the clamping arms is generally shown in FIGS. 3–5. As shown in FIGS. 3 and 4, each hub 25 is fixed to a central drive shaft 24. The drive shafts 24 are mounted on bearing assemblies 50 and connected by connection shafts 52 to a hydraulically operated rack and pinion drive means shown in detail in FIG. 5. The connection shafts are secured to an internal bore in pinion 36 which has teeth in engagement with upper and lower rack members 37 and 38, respectively. The rack members are driven transversely to the axis of the drive shaft hydraulically. The rack members 37 and 38 are each shaped such that they function as pistons in the upper and lower hydraulic cylinders 39. When hydraulic fluid is supplied under pressure to the left side of the lower cylinder and to the complementary right side of the upper cylinder, the lower rack member 38 is driven to the right and the upper rack member 37 is driven to the left, as shown in FIG. 5 together imparting a counterclockwise rotation of 90° to the pinion and drive shaft until the overcenter locking assemblies fixed to the drive shaft assume the position shown in FIG. 7. Likewise, when hydraulic fluid is simultaneously forced under pressure into the right side of the lower cylinder and the left side of the upper cylinder, the lower rack member 38 is forced to the left and the upper rack member 37 to the right imparting a clockwise rotation to the pinion and drive shaft. Fluid is supplied through fluid lines 43 simultaneous to the respective upper and lower hydraulic cylinders from a hydraulic power unit 44 which is in turn driven by an electric motor 47. Both the hydraulic power unit 44 and electric motor 47 are secured to frame 16 by the support 49.

OPERATION

Figure 6:
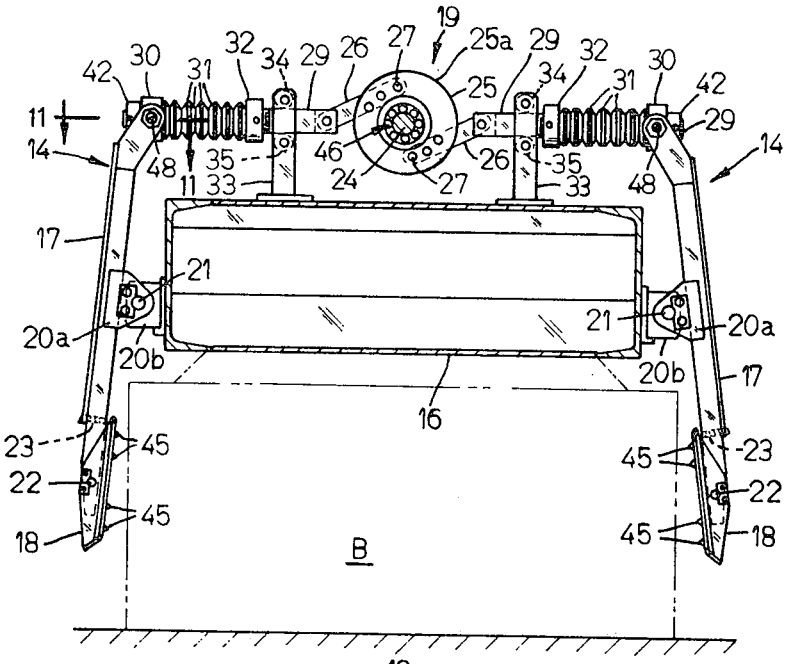
FIG. 6 is a cross section end view of one of the clamping assemblies in the open position taken along line 6—6 shown in FIG. 3.

In the operation of the apparatus, the grapple means is moved by the overhead crane into a position as shown in FIG. 1 where each of the clamping arms are spaced around a block of material as shown in FIG. 6. The clamping arms 17 and plates 18 are in an open position with the shafts 29 extended toward the drive shaft 24 and with the ends of the toggle arms 26 connected to hub 25 being in nearly vertical alignment with respect to each other.

Figure 7:
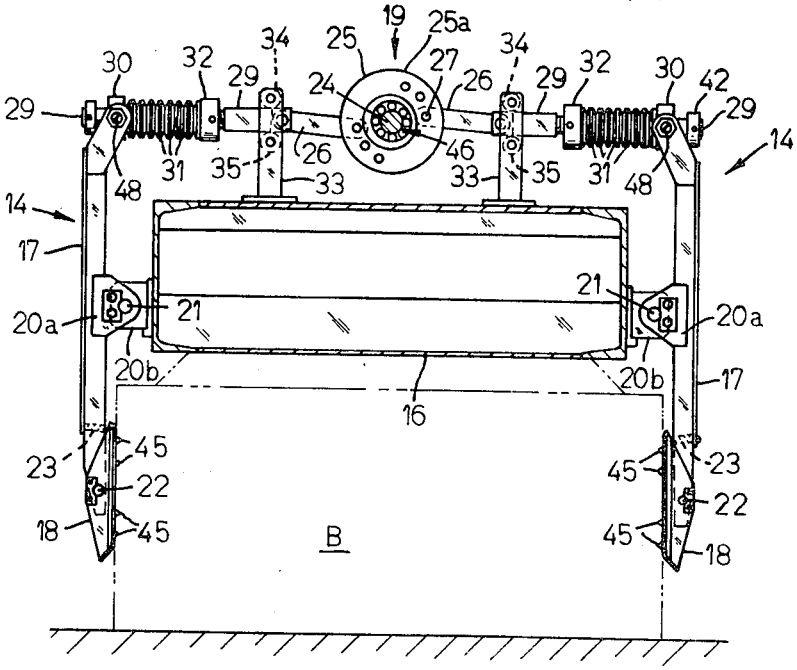
FIG. 7 is a view similar to that of FIG. 6 but showing the clamping assembly when clamping force is applied.

When the hydraulic power unit 44 is actuated, the rack and pinion drive means is caused to rotate the drive shafts 24 90° causing each of the clamping assemblies to assume the position shown in FIG. 7. As the drive shaft and the hub 25 rotate, the toggle arms 26 force the shafts 29 connected thereto to move axially away from the hub 25. The nuts 32 fixed to the respective shafts 26 then compress the spring discs 31 against the guide blocks 30 forcing the clamping arms 17 to pivot about pivot pins 21 and to thereby bring each of the clamping plates 18 into simultaneous clamping engagement with each of the blocks of material B.

As further shown in FIG. 7, when the clamping arms 17 are forced into clamping engagement, the flanged hub 25 has rotated counterclockwise to an extent that the ends of the toggle arms pivotably attached to the hub have rotated beyond the horizontal center line of the hub. It can be readily understood that the compression of the spring discs 31 between the nut 32 and guide block 30 exerts axial force on the shaft 29 and causes the toggle arm 26 to exert an additional counterclockwise torque on the hub 25. In this position, however, the hub and drive shaft 24 are prevented from further clockwise rotation because the rack members 37 and 38 are prevented from further movement by the ends of the respective hydraulic cylinders. Thus, once the clamping arms are brought into clamping engagement with a block of material, the spring biased shaft 29, the over-center position of the toggle arm 26, and hub 25 provide a means of locking the clamping arm 17 into clamping engagement. Only by reversing the flow of hydraulic fluid to the rack and pinion drive means 60 thereby turning the drive shaft 24 in a clockwise direction can the clamping arms release the block B. The over-center locking assembly 19 thus prevents the blocks from being released from the grip of the clamping arms 17 in the event that the hydraulic power 44 is in some manner interrupted during transfer of the blocks.

To release the blocks from the clamping arms, the hydraulic fluid flow to the rack and pinion means 60 is reversed. The drive shaft 24 is caused to rotate in the clockwise direction causing the toggle arms 26 to pull the shafts 29 towards the drive shaft 24 until the nut 42 abuts the guide block 30 thereby causing the lower end of the clamping arm 17 to pivot away from the block B.

A principal advantage of the construction of the grapple means of the invention, is that, as shown in FIG. 2, the structure of the mast extension and grapple means is very little wider than the blocks to be lifted. Therefore, during storage, the blocks may be stacked in relatively close relation to each other while still allowing sufficient space for the clamping arms to grip the blocks.

Another advantage of the apparatus of the invention is that the grapple means grip the blocks of material at the sides and do not require spaces under the blocks such that projections can grip the block from the bottom. Thus, it is not necessary to provide pallets or some other means of spacing the blocks, thereby saving storage space and avoiding the cost of the pallets or other spacing means.

It is a further advantage of the present invention that relatively rigid masts are used instead of flexible cables to suspend the grapple assembly from the overhead crane. Cables have the disadvantage of allowing pendulous motion of the grapple assembly thereby causing greater difficulty in accurate positioning of the blocks and requiring unnecessary use of storage space and loss of time during operation of the overhead crane. The rigid masts used in the present invention, however, overcome these problems with respect to the use of cables by facilitating accurate positioning of the grapple assembly thereby allowing the blocks to be closely spaced, and furthermore allowing more rapid movement of the grapple assembly since it will not be subjected to pendulous motion.

The use of flexible cables on the other hand has the advantage of generally allowing some degree of misalignment of the grapple assembly with respect to the row of blocks to be picked up. However, an additional advantage of the present invention is that the clamping arms are independently moved into clamping engagement by springs rather than a rigid linkage and can therefore compensate for the rigidity of the masts because the springs give the clamping arms a resiliency such that the row of blocks may be picked up even though they are slightly out of alignment with respect to the grapple assembly or with respect to each other. For example, when the blocks are stacked one on top of the other, as shown in FIG. 2, any inherent surface irregularities of the blocks may cause them to shift slightly such that the blocks are out of alignment. When the grapple assembly is used to pick up these blocks, the spring discs biasing the clamping arms into clamping engagement allow the clamping arms to move independently of each other when gripping the blocks so that the arms can move different distances as required to firmly grip the block and without shifting the blocks laterally while they are resting on other blocks.

A further advantage of the toggle linkage including the spring discs is that once the blocks are raised from a supporting surface the spring discs then allow lateral shifting of the blocks to evenly distribute the forces applied by the clamping arms. This results in a self-aligning effect on the blocks to insure that they will be properly aligned when they are again set down.

RESUME

The grapple apparatus of the present invention thus provides means for gripping a plurality of large blocks of material simultaneously such that they can be moved by an overhead crane from one position to another, and provides means for gripping the blocks such that, even if there is loss of power to the grapple apparatus, the blocks will not be released.

The invention also sets forth grapple means which facilitate compact storage of the rows of blocks of material requiring only narrow spaces between the rows of blocks in which to operate and allows stacking of the blocks without the use of pallets or other means of vertical separation.

I claim:

1. An overhead crane having telescoping mast means extending downwardly and terminating in vertically moveable lower extensions, and a horizontally extending frame member carried by the lower extensions for vertical positioning therewith, a plurality of clamping arms pivotably supported by said frame member and spaced along opposite sides of said frame member to define a plurality of opposed pairs of clamping arms, each of said opposed pairs for engaging a load therebetween, and drive means for forcing the lower ends of each pair of opposed clamping arms in a directon to clampingly engage a load located between said opposed arms and for releasably locking each pair of opposed clamping arms in clamping engagement with the load therebetween, said drive means including a rotatably driven shaft rotatably supported by said frame member, a plurality of linkage members, each of said linkage members operably connecting said driven shaft and one of said clamping arms, said each of said linkage members having opposite ends, one of said ends being connected to said driven shaft off-center thereof and the other of said ends being shiftably connected to one of said clamping arms, and spring means between said each of said linkage members and said one of said clamping arms.

2. The crane set forth in claim 1 further characterized by said clamping arms being vertically positioned and pivotably attached at a point generally intermediate their length to the frame member.

3. The crane set forth in claim 1 wherein said drive means includes a hub secured to said driven shaft, and wherein one of said linkage members is pivotably connected to said hub.

4. The apparatus set forth in claim 3 wherein said one of said linkage members includes a toggle arm and a shaft member pivotably joined, said toggle arm connected at one end to the hub and off-center thereof, said shaft member being shiftably connected to said one of said clamping arms.

5. The apparatus set forth in claim 3 further characterized by said driven shaft being operably connected to a hydraulic power source by a rack and pinion assembly.

* * * * *